United States Patent [19]

Tomes et al.

[11] Patent Number: 5,044,962

[45] Date of Patent: Sep. 3, 1991

[54] TERMINAL BLOCK

[75] Inventors: Alexander Tomes; Jacobus T. Barbier, Jr., both of Calgary, Canada

[73] Assignee: Circa Telecommunications, Inc., Calgary, Canada

[21] Appl. No.: 446,298

[22] Filed: Dec. 5, 1989

[51] Int. Cl.[5] ..... H01R 9/28

[52] U.S. Cl. ..... 439/54; 439/689; 439/721; 439/108

[58] Field of Search ..... 439/689, 752, 54, 92, 439/101, 108, 922, 721, 724, 686, 695, 701; 379/326, 327, 331, 332; 361/355, 361

[56] References Cited

U.S. PATENT DOCUMENTS

| | | | |
|---|---|---|---|
| 2,401,430 | 6/1946 | Lake | 173/328 |
| 2,457,703 | 12/1948 | Merkel | 173/328 |
| 2,927,295 | 3/1960 | Sitz | 339/18 |
| 2,967,285 | 1/1961 | Freitas | 339/18 |
| 3,004,235 | 10/1961 | Cohen | 339/18 |
| 3,088,087 | 4/1963 | Colten | 339/18 |
| 3,151,923 | 10/1964 | Bell et al. | 339/18 |
| 3,568,001 | 3/1971 | Straus | 339/17 |
| 3,621,444 | 11/1971 | Stein | 439/689 |
| 3,760,328 | 9/1973 | Georgopulos | 339/18 R |
| 3,936,133 | 2/1976 | Splitt et al. | 439/54 |
| 4,109,993 | 8/1978 | Bauerle | 439/695 |
| 4,669,799 | 6/1987 | Vachhania et al. | 439/404 |
| 4,828,506 | 5/1989 | Tuckwood | 439/752 |

*Primary Examiner*—Gary F. Paumen

*Attorney, Agent, or Firm*—Heiskell, Donelson, Bearman, Adams, Williams & Kirsch

[57] ABSTRACT

A terminal block having a front face and a rear face is provided. An array of counterbores are formed in the terminal block which extend between the faces and define abutment surfaces therein. The counterbores are positioned so that the portion of greater diameter is adjacent the rear face. The counterbores are adapted to receive terminal contacts via the rear face so that the female end of the terminal contacts rest near the front face. Grooves are formed in the rear face which connect selected counterbores. The selected counterbores received one type of terminal contact having a male end of reduced length. A face plate having apertures formed therein is removably secured to the rear face. The apertures are aligned with only the counterbores receiving another type of terminal contact having a male end which extends beyond the rear face to allow the male ends to pass. Ground wires are passed along the grooves and contact the male end of the one type terminal contacts.

13 Claims, 3 Drawing Sheets

TERMINAL BLOCK

TECHNICAL FIELD

The present invention relates to a terminal blocks and in particular to a terminal block for telecommunication lines and the like.

BACKGROUND OF THE INVENTION

Terminal blocks for telecommunication lines are well known in the art. Typically, these blocks are formed from a moulded insulating material and include a front face and a rear face. Passages extending between the faces are formed in the block and house terminal contacts. The terminal contacts are connected at one end to the incoming telecommunication lines and receive plug-in type protector assemblies at the other end. Many designs for these types of blocks have been considered to facilitate installment.

In particular, U.S. Pat. No. 3,936,133 to Splitt et al shows a connector block for mounting plug-in type protector assemblies to protect telephone equipment from high voltage and current surges in incoming telephone lines. The connector block includes a mounting panel or housing having ten groups of sockets and ten groups of terminals extending through the mounting panel. The sockets are aligned on the mounting panel adjacent the side edge and each group consists of five sockets or holes which are generally cylindrical in shape. However, the sockets near the rear face of the mounting panel become generally U-shaped. A terminal contact is pushed into each socket from the front side of the mounting panel until the shoulder of the terminal contact abuts against the rear face of the panel and so that the male end of each contact passes through the U-shaped aperture. With the terminal contacts in this position, incoming telecommunication lines are connected to the male ends of the terminal contacts and plugs are pushed into the sockets to mate with the female ends of the terminal contacts. Smaller ground terminal contacts pass through one of the sockets in each group and project beyond the rear of the mounting panel a distance less than the other terminal contacts. A conductor extends across each of the shorter contacts to connect the shorter contacts to a common ground.

However, a problem exists in this type of connector block in that the terminal contacts must be pushed into the sockets via the front face in a manner which ensures that the male U-shaped end of each terminal contact is aligned with the U-shaped aperture formed in the rear face of the panel. This of course increases the time required to assemble the panel for use. Furthermore, another problem exists in that the ground bar interconnecting each of the shorter terminal contacts must be soldered to each individual contact, a task which of course is time consuming.

It is therefore an object of the present invention to obviate or mitigate the above disadvantages.

Broadly stated, the present invention provides a terminal block having a front face and a rear face with an array of counterbores provided therein extending between said faces to define at least one abutment surface in each of said counterbores;

at least one groove formed in said rear face and connecting selected ones of said counterbores whereby the counterbores provide an interference fit for a terminal contact having dissimilar ends inserted therein via said rear face.

Preferably, a face plate is removably secured to the rear face of the terminal block and includes an array of apertures formed therein with each of the apertures being associated with one of the counterbores. The apertures are configured to allow the male end of the terminal contacts to pass therethrough with facility.

In another aspect of the present invention, there is provided a connector panel including a terminal block having a front face and a rear face with an array of counterbores provided therein extending between said faces to define at least one abutment surface in each of the counterbores;

at least one groove for receiving a ground wire formed in the rear face and connecting selected ones of the counterbores;

a terminal contact seated in each of said counterbores, each of said terminal contacts having a female end adjacent said front face for receiving a connector plug, said terminal contacts associated with the other counterbores having a male end extending beyond said rear face; and a face plate removably secured to said rear face, said face plate including an array of apertures formed therein, each of said apertures being associated with one of said terminal contacts and allowing the male end of said terminal contacts to pass therethrough.

A method of forming a connector panel is also provided.

SUMMARY OF THE INVENTION

The present invention provides advantages in that, since the terminal contacts can be inserted into the counterbores via the rear face and since the apertures formed in the face plate are configured to allow the male ends of the terminal contacts to pass therethrough with facility, the time required to assemble the connector panel is greatly reduced. Furthermore, since a ground wire can be pushed along the groove to connect selected terminal contacts to a common ground, the assembly time of the connector panel is further reduced as compared with prior art arrangements.

BRIEF DESCRIPTION OF THE DRAWINGS

An embodiment of the present invention will now be described by way of example only with reference to the accompanying drawings in which.

DETAILED DESCRIPTION

Figure 1:
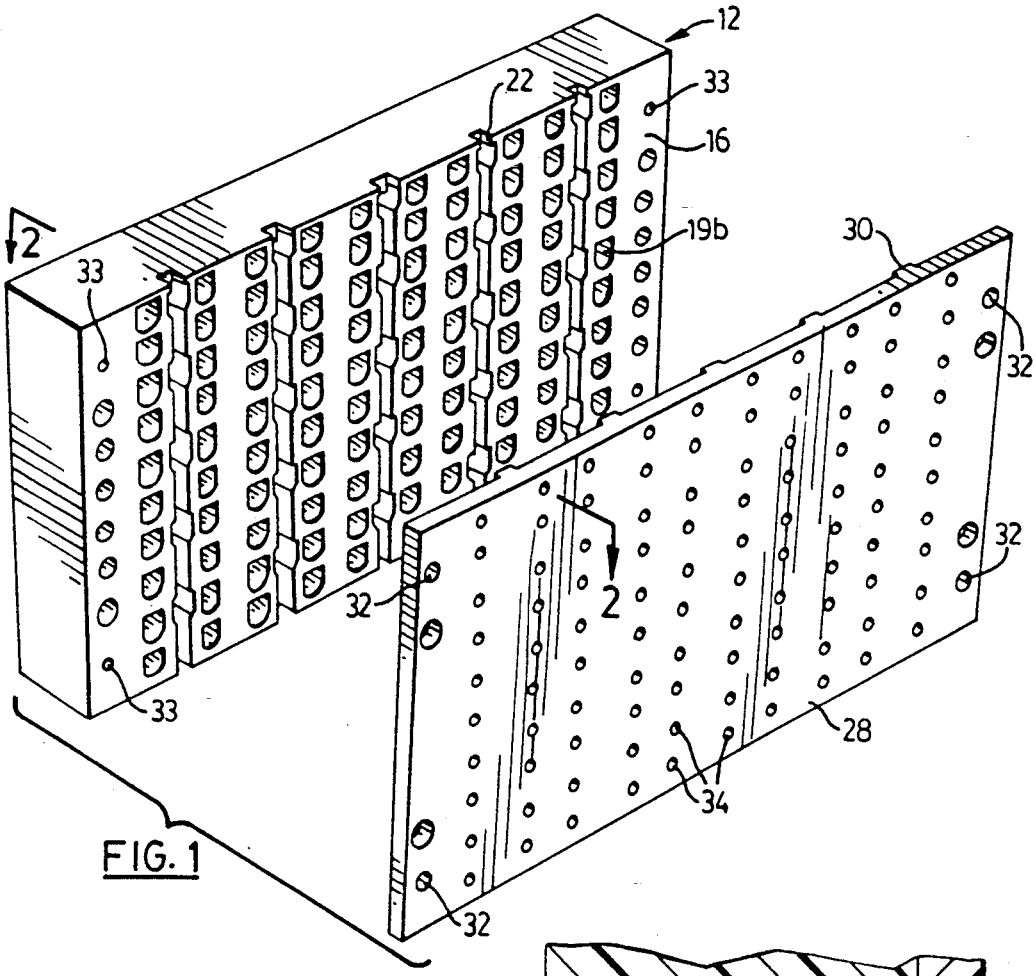
FIG. 1 is a perspective view of a terminal block.
Figure 2:
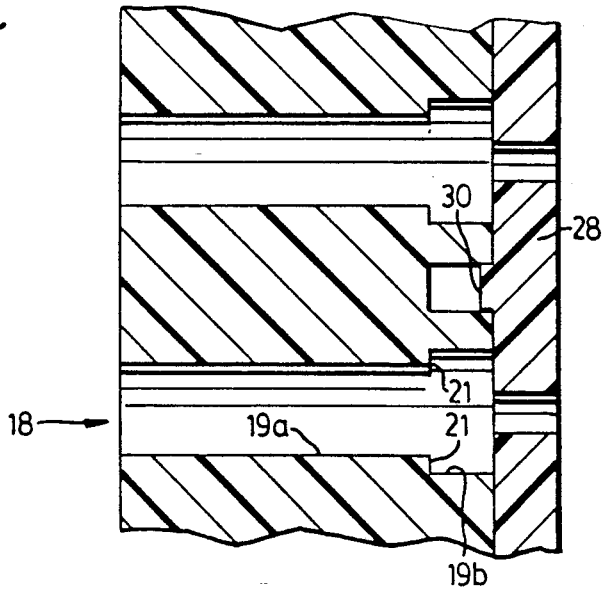
FIG. 2 is a sectional view of a portion of the terminal block illustrated in FIG. 1 taken along line 2—2.

Referring to FIGS. 1 to 5, a terminal block for mounting plug-in type protector assemblies to protect telephone equipment from voltage and current surges is provided and generally indicated by reference numeral 10. The terminal block 10 includes a mounting panel 12 formed from an insulating moulded plastic and having a front face 14 and a rear face 16. An array of groups of sockets 18 are formed in the panel 12 and extend between the faces 14 and 16. Each group of sockets 18 includes five sockets 18A to 18E arranged to receive a plug-in type protector assembly 20. Each of the sockets has a generally cylindrical portion 19*a* and a generally arch-shaped portion 19*b* with the interface between the portions defining abutment surfaces 21.

Grooves 22 are formed in the rear face 16 with each groove being associated with one column of the groups of sockets. The grooves 22 connect one of the sockets 18C in each group and extend between opposed sides of the terminal block 10.

A face plate 28 is associated with the rear face 16 and has ridges 30 formed thereon which seat in the grooves 22 when the face plate is connected to the rear face. Holes 32 are formed in the plate at various locations to permit the face plate 28 to be secured to the panel 12 via screws (not shown) which threadably engage with threaded bores 33 formed in the panel 12. The ridges 30 project outwardly from the face plate 28 a distance less than the depth of the grooves 22 to define passages 35 when the face plate 28 is secured to the panel 12. Circular apertures 34 are also formed in the face plate 28 and are arranged so that each aperture is associated with one of the sockets not connected by a groove 22.

Figure 3:
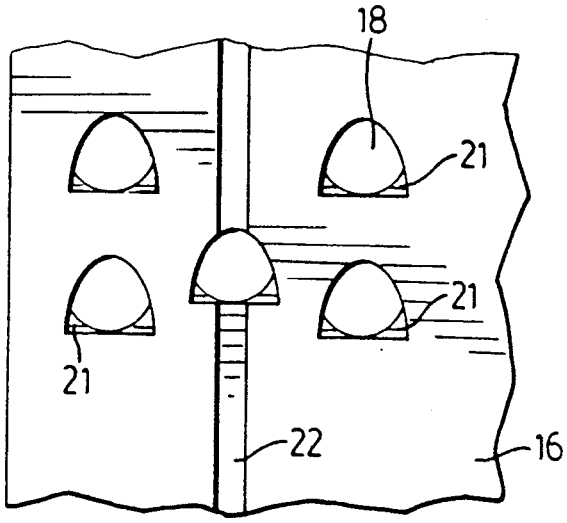
FIG. 3 is a plan view of a portion of the terminal block illustrated in FIG. 1.
Figure 4:
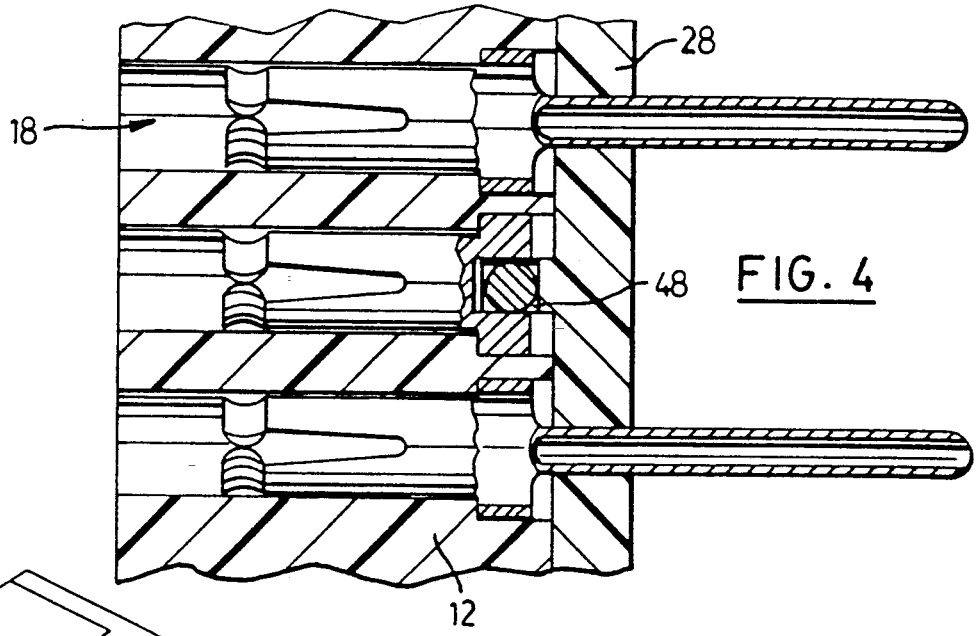
FIG. 4 is a sectional view of a portion of the terminal block illustrated in FIG. 1 housing terminal contacts.
Figure 5:
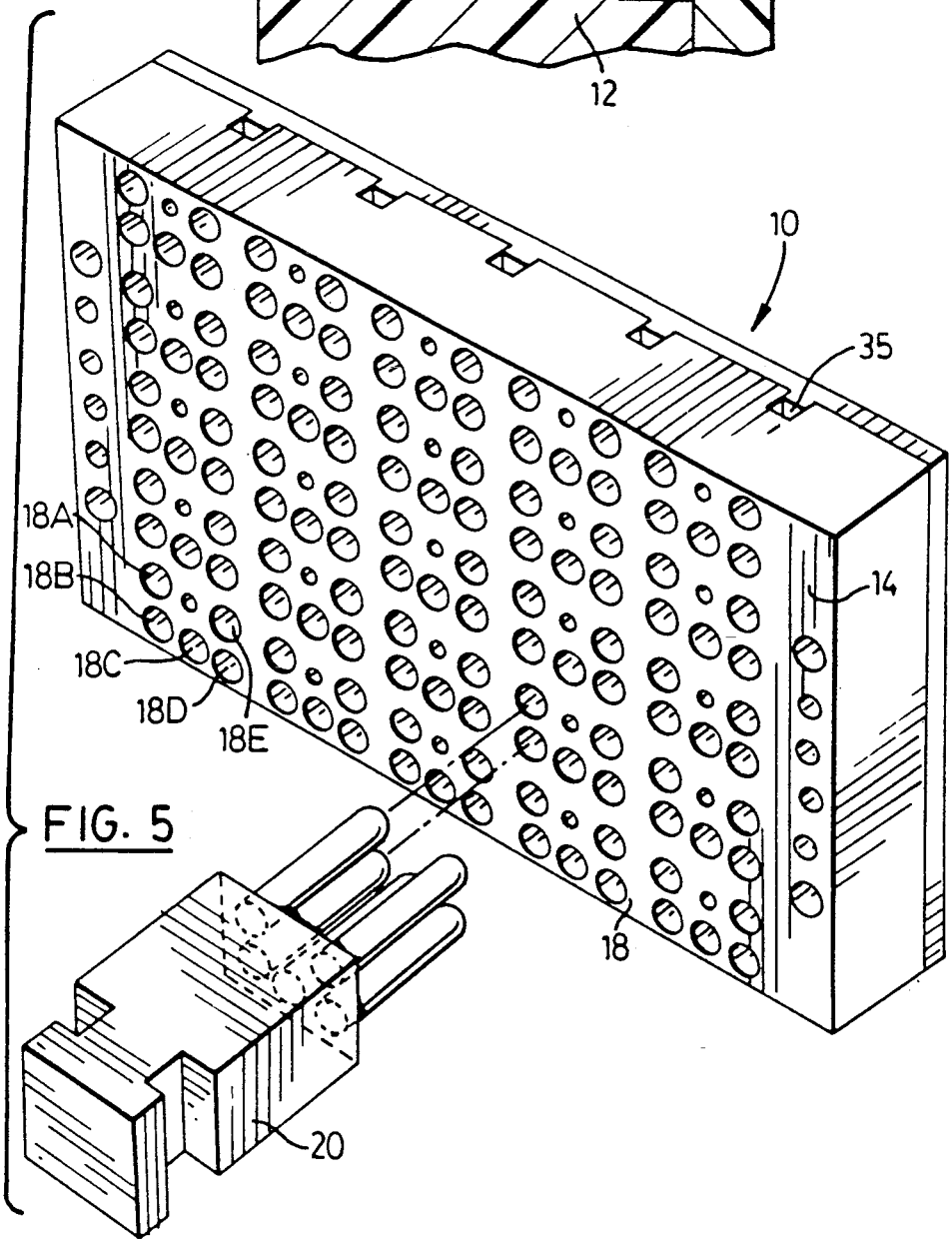
FIG. 5 is another perspective view of the terminal block shown in FIG. 1.

In operation, when it is desired to use the terminal block 10 as a connector panel for incoming telecommunication lines, the face plate 28 is firstly removed from the rear face 16 of the panel 12 if it has not already been done. Thereafter, terminal contacts 40 as shown in the FIG. 3 are inserted into each of the sockets 18. As can be seen, the terminal sockets are inserted via the rear face 16 so that the female end 42 of the terminal contacts rest adjacent the front face 14 and so that the clips 44 formed on the terminal contacts abut the abutment surfaces 21. This results in each of the terminal contacts forming an interference fit with its associated socket. The terminal contacts 40*a* inserted into the sockets 18C associated with a groove 22 are reduced in length and include a notch 48 at the male end thereof. The notch 48 provided on each of these terminal contacts 40*a* rests in the associated groove 22. The remainder of the terminal contacts 40 include a U-shaped tip 50 at the male end thereof which extends beyond the rear face 16. Once the terminal contacts have been placed in each of the sockets 18 via the rear face, the face plate 28 is placed over the rear face 16 so that the male tips 50 pass through the apertures 34. The face plate 28 is then secured to the panel 12 via the screws so that the ridges 30 rest in the grooves 22 thereby defining the passages 35.

With the terminal block 10 housing the terminal contacts 40, the incoming telecommunication lines are soldered or otherwise connected to each of the male tips 50. Furthermore, ground conductors 52 are pushed into the passages 35 so that the conductors 52 pass through the notches 48. This permits each of the terminal contacts 40*a* disposed within each groove 22 to be electrically connected to a common ground. Once this is done, the plug-in type protector assemblies 20 can be pushed into the sockets 18 via the front face 14 to engage the female end 42 of the terminal contacts. This allows the incoming telecommunication lines to be connected to telecommunication line equipment whilst being shielded from high voltage and current surges on the telecommunication lines.

The present invention provides advantages in that since the face plate overlying the rear face of the terminal block is removable and since the sockets provide an interference fit for the terminal contacts when and inserted therein via the rear face. The placement of the terminal contacts within the terminal block is facilitated. This, of course, greatly decreases the time required to assemble the contact panel as compared with prior art panels.

Moreover, the provision of the circular apertures in the face plate permits the passage of the male tips therethrough regardless of the orientation of the terminal contacts in the sockets. Still yet another advantage is provided in that the provision of the groove in the rear face in combination with the terminal contacts of reduced length associated with sockets interconnected by the grooves facilitates the connection of these terminal contacts to a common ground.

It should be apparent to one of skill in the art that various modifications can be made to the present invention without departing from the scope thereof as defined by the appended claims.

We claim:

1. A terminal block having a front face and a rear face with an array of bores provided therein extending between said faces and defining at least one abutment surface in each of said bores, said array of bores being arranged in rows of predetermined sets of bores, each of said bores including a first portion which is generally circular in section and a second portion which is generally arched-shaped in section, said second portions having radial dimensions extending beyond the diameter of said first portions to define said abutment surfaces at the interface between said first and second portions, each predetermined set of bores being arranged in a generally U-shaped configuration which defines a pair of limbs and a bight portion;

at least one groove formed in said rear face in association with each of said rows, each of said grooves connecting a central bore located in the bight portion of each predetermined set of bores in the associated row, said bores providing an interference fit for terminal contacts inserted therein via said rear face; and a face plate removably secured to said rear face, said face plate including an array of apertures formed therein, each of said apertures being associated with one of said bores to allow one end of terminal contacts seated in said bores to pass therethrough.

2. A terminal block as defined in claim 1 wherein each of said predetermined sets includes five bores.

3. A terminal block as defined in claim 2 wherein said grooves have a square cross-section.

4. A terminal block as defined in claim 3 wherein the deptH of said grooves is selected so that the bottom of each of said grooves is positioned closer to said rear face than said abutment surface.

5. A terminal block as defined in claim 1 wherein said apertures are of a circular cross-section.

6. A terminal block as defined in claim 1 further including ridges formed on said face plate, said ridges being aligned with said grooves and partially extending therein.

7. A connector panel including a terminal block having a front face and a rear face with an array of bores provided therein extending between said faces and defining at least one abutment surface in each of the bores;

at least one groove for receiving a ground wire formed in the rear face and connecting selected ones of the bores;

first type terminal contacts having a male end and a female end seated in the bores connected by said groove;

second type terminal contacts having a male end and a female end and seated in the remaining bores whereby said first and second type terminal contacts form an interference fit with the bores and are inserted therein via said rear face with the female end thereof being adjacent the front face;

a face plate having apertures formed therein associated with the bores, said face plate allowing the male end of said second type terminal contacts to pass therethrough via the apertures, the male end of said first type terminal contacts being reduced in length as compared with said second type terminal contact and terminating at said groove; and a ground wire extending along said at least one groove to connect electrically the male ends of the first type terminal contacts.

8. A connector panel as defined in claim 7 wherein said face plate includes ridges aligned with said grooves and extending partially therein.

9. A connector panel as defined in claim 7 wherein each of said bores includes a first portion which is circular in section and a second portion which is generally arch-shaped in section, said second portion having radial dimensions extending beyond the diameter of the first portion to define said abutment surfaces at the interface between said first and second portions.

10. A connector panel as defined in claim 9 wherein said bores are arranged in rows of predetermined sets with a plurality of rows constituting said array, said grooves extending the length of said rows and connecting at least one of the bores in each set forming said rows.

11. A connector panel as defined in claim 10 wherein each of said sets includes five bores.

12. A connector panel as defined in claim 11 wherein said five bores in each predetermined set are arranged in a generally U-shaped configuration defining a pair of limbs and a bight portion with a central bore being provided in the bight portion of the configuration and communicating with said groove.

13. A method of forming a connector panel comprising the steps of:

providing a terminal block having a front face and a rear face with an array of bores provided therein and extending between said faces and defining at least one abutment surface in each of said bores;

providing at least one groove in the rear face connecting selected ones of the bores;

inserting a first type terminal contact having a male end and a female end into the bore connected by a said groove via said rear face;

inserting a second type terminal contact having a male end and female end into the remaining bore via said rear face whereby said first and second type terminal contact form an interference fit with the female ends thereof being adjacent the front face;

securing a face plate having apertures formed therein associated with the ores to the rear face, said face plate allowing the male end of said second type terminal contacts to pass therethrough via said apertures, the male ends of said first type terminal contacts being reduced in length as compared with said second type terminal contacts and terminating at said groove; and extending a ground wire along said groove to connect electrically the male ends of the first type terminal contacts.

* * * * *

UNITED STATES PATENT AND TRADEMARK OFFICE

CERTIFICATE OF CORRECTION

PATENT NO. : 5,044,962

DATED : SEPTEMBER 3, 1991

INVENTOR(S) : TOMES, ET AL.

It is certified that error appears in the above-identified patent and that said Letters Patent is hereby corrected as shown below:

Line 5, Column 1 word "blocks" should be - block -;

Line 53, Column 4 word "deptH" should be - depth -;

Line 18, Column 6 word "bore" should be - bores -;

LIne 22, Column 6 word "bore" should be - bores -;

Line 23, Column 6 word "contact" should be - contacts -; and

Line 27, Column 6 word "ores" should be - bores -.

Signed and Sealed this

Second Day of March, 1993

*Attest:*

STEPHEN G. KUNIN

*Attesting Officer*

*Acting Commissioner of Patents and Trademarks*